US009041502B2

(12) United States Patent
Ansari et al.

(10) Patent No.: US 9,041,502 B2
(45) Date of Patent: May 26, 2015

(54) HEAT DISSIPATING ELECTROMAGNETIC DEVICE ARRANGEMENT

(75) Inventors: Ajmal Ansari, Canton, MI (US); Nadir Sharaf, Bloomfield Township, MI (US); Slobodan Pavlovic, Novi, MI (US)

(73) Assignee: Lear Corporation, Southfield, MI (US)

( * ) Notice: Subject to any disclaimer, the term of this patent is extended or adjusted under 35 U.S.C. 154(b) by 1 day.

(21) Appl. No.: 13/440,063

(22) Filed: Apr. 5, 2012

(65) Prior Publication Data

US 2013/0265129 A1 Oct. 10, 2013

(51) Int. Cl.

| | |
|---|---|
| ***H01F 27/08*** | (2006.01) |
| ***H01F 27/10*** | (2006.01) |
| ***H01F 27/02*** | (2006.01) |
| ***H01F 27/22*** | (2006.01) |

(52) U.S. Cl.
CPC ..... *H01F 27/22* (2013.01)

(58) Field of Classification Search
USPC ..... 336/61, 55, 56, 57, 58, 60, 90, 92
See application file for complete search history.

(56) References Cited

U.S. PATENT DOCUMENTS

| | | | | |
|---|---|---|---|---|
| 3,883,834 | A | 5/1975 | Osteen | |
| 5,204,653 | A * | 4/1993 | Saitoh et al. | 336/178 |
| 5,469,124 | A | 11/1995 | O'Donnell et al. | |
| 5,634,262 | A * | 6/1997 | O'Donnell et al. | 29/606 |
| 5,920,249 | A | 7/1999 | Huss | |
| 6,392,519 | B1 * | 5/2002 | Ronning | 336/90 |
| 7,164,584 | B2 | 1/2007 | Walz | |
| 7,746,211 | B2 * | 6/2010 | Pokharna et al. | 336/229 |
| 8,164,406 | B2 * | 4/2012 | Lin et al. | 336/61 |
| 8,284,006 | B2 * | 10/2012 | Bacarisse | 336/90 |
| 2003/0197583 | A1 * | 10/2003 | Choi | 336/58 |
| 2011/0140820 | A1 * | 6/2011 | Guentert et al. | 336/58 |
| 2012/0299678 | A1 * | 11/2012 | Inaba et al. | 336/61 |
| 2013/0038415 | A1 * | 2/2013 | Ooishi et al. | 336/61 |

FOREIGN PATENT DOCUMENTS

WO WO2011132361 * 10/2011

* cited by examiner

*Primary Examiner* — Elvin G Enad
*Assistant Examiner* — Kazi Hossain
(74) *Attorney, Agent, or Firm* — Brooks Kushman P.C.

(57) ABSTRACT

An electromagnetic device arrangement includes a transformer assembly having a core, windings, and a housing disposed around at least a portion of the core and windings. An enclosure at least partially encloses the transformer assembly. The transformer assembly is mounted to a first portion of the enclosure such that heat is transferred from the transformer assembly to the first portion of the enclosure. A second portion of the enclosure has an extension extending therefrom such that the extension is placed in thermal contact with the transformer assembly to transfer heat from the transformer assembly to the extension.

20 Claims, 1 Drawing Sheet

HEAT DISSIPATING ELECTROMAGNETIC DEVICE ARRANGEMENT

TECHNICAL FIELD

The present invention relates to a heat dissipating electromagnetic device arrangement.

BACKGROUND

Electromagnetic devices, such as inductors and electrical transformers, may be constructed in many different ways. One common way is to have windings at least partially surrounded by a core, which may be, for example, made from a ferrite material. The core may be made from two or more pieces bonded to each other with an adhesive material such as an epoxy. The windings and core may be covered with a potting material and surrounded by a housing that allows the transformer to be mounted to another structure, such as a base plate or mounting pad.

Increasingly, electromagnetic devices are used in electronic devices wherein, for example, a transformer, including a transformer housing, may be placed within a larger enclosure. This can create problems for heat dissipation, for example, because of a lack of convective airflow over the transformer within the enclosure. Although there may be some heat transfer between the transformer and the base plate or mounting pad, this can actually cause additional problems.

Specifically, when one portion of the core dissipates much of its heat to the base plate, while the other portion of the core does not, a thermal gradient can be created between different portions of the transformer core. When different portions of the transformer core are at markedly different temperatures, the temperature gradient between the portions of the core can create thermally induced stress, which may then cause the core to crack or otherwise fail. Therefore, a need exists for a transformer arrangement configured to effectively dissipate heat so as to inhibit the formation of thermal gradients within the transformer, even when the transformer is disposed within a larger enclosure conducive to heat buildup.

SUMMARY

Embodiments of the invention include an electromagnetic device arrangement having an electromagnetic device including a core, a plurality of windings, and a housing disposed around at least a portion of the core and windings. An enclosure at least partially encloses the electromagnetic device. A first portion of the enclosure has the electromagnetic device mounted thereto such that heat is transferred from the electromagnetic device to the first portion of the enclosure. A second portion of the enclosure has an extension extending therefrom such that the extension is placed in thermal contact with the electromagnetic device so that heat is transferred from the electromagnetic device to the extension.

Embodiments of the invention include an electrical device having an electromagnetic device, which includes a plurality of windings, a split core bonded together with an adhesive material, and a housing disposed at least partially around the windings and the core. A base or base plate has the electromagnetic device mounted thereto and it is in thermal contact with the electromagnetic device, such that heat from a first portion of the core transfers substantially to the base plate. A cover is attachable to the base plate to form an enclosure at least partially enclosing the electromagnetic device. The cover includes an extension extending therefrom, which is in thermal contact with the electromagnetic device when the cover is attached to the base plate. The thermal contact between the extension and the electromagnetic device is such that heat from a second portion of the core transfers substantially to the extension.

Embodiments of the invention include an electromagnetic device arrangement having an enclosure including a first portion and a second portion. A electromagnetic device includes a core, a plurality of windings, and a housing disposed around at least a portion of the core and windings. The electromagnetic device is mounted to and in thermal contact with the first portion of the enclosure, and the second portion of the enclosure is configured to thermally contact the electromagnetic device when the first and second portions of the enclosure are attached to each other.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
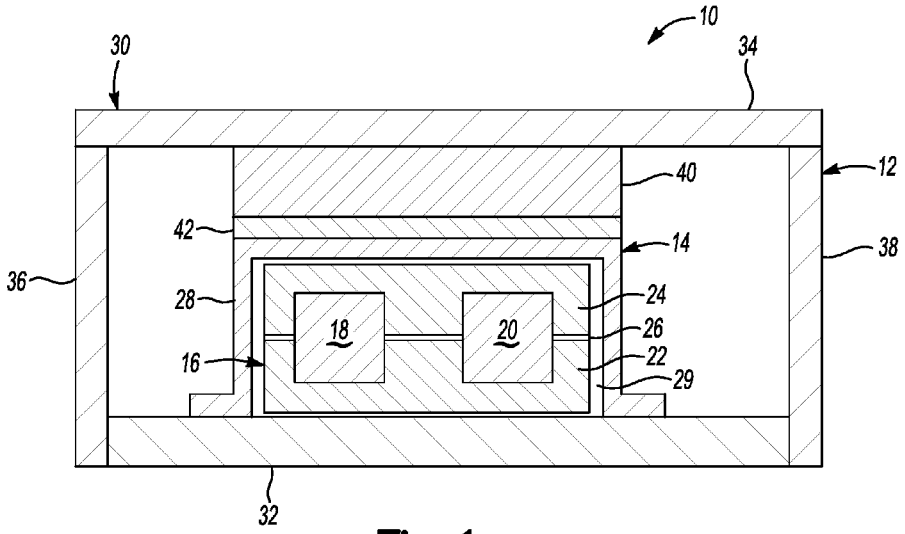
FIG. 1 shows an electromagnetic device arrangement in accordance with embodiments of the present invention.
Figure 2:
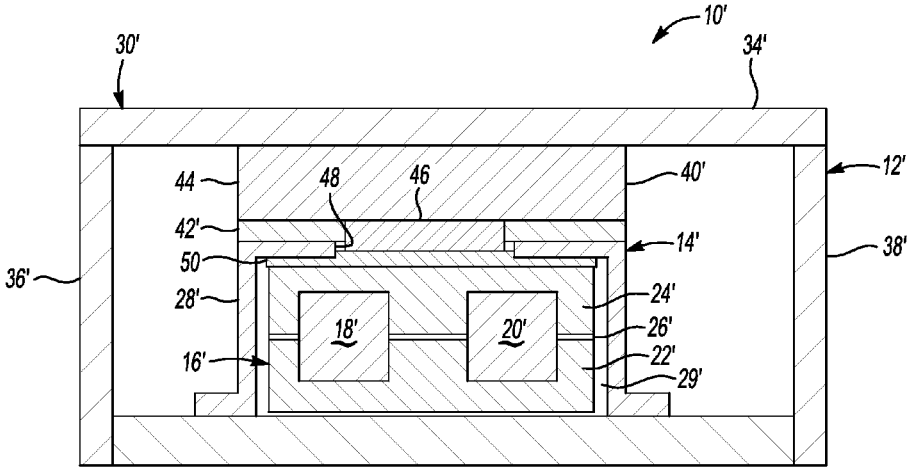
FIG. 2 shows another electromagnetic device arrangement in accordance with embodiments of the present invention.

FIG. 1 shows an electromagnetic device arrangement, or transformer arrangement 10, in accordance with embodiments of the present invention. In the embodiment shown in FIG. 1, the transformer arrangement 10 comprises an electrical device, or battery charger 12. Other types of electrical devices that utilize electromagnetic devices in accordance with embodiments of the invention include such electrical devices as a switching power supply, used in many electronic devices, and photovoltaic cells or wind power generators, which generate low voltage direct current (DC) power that needs to be inverted into higher voltage alternating current (AC) power for general consumption. It is understood that although the electromagnetic devices illustrated in FIGS. 1 and 2 are transformers, embodiments of the invention may include other electromagnetic devices, such as inductors and other electromagnetic devices.

The transformer arrangement 10 includes an electromagnetic device, or transformer assembly 14, that is made up of a core 16 and windings 18, 20. The core 16 is a split core, having a first or lower portion 22 and a second or upper portion 24. A core, such as the core 16, may be made from a ferrite material, which although very strong in compression, may not be as strong when subjected to tensile stress. Bonding the lower and upper portions 22, 24 is an adhesive 26, which may be, for example, a material having a high Young's Modulus, which does not allow significant differential thermal expansion and contraction to occur between the lower and upper portions 22, 24 of the core 16. In other embodiments, metal C-clips or U-clips may be used to hold portions of the core together. The transformer assembly 14 also includes a housing 28, which is disposed around at least a portion of the core 16 and windings 18, 20. A potting material 29 surrounds the core 16 and windings 18, 20, and generally fills the space between them and the housing 28.

An enclosure 30 encloses the transformer assembly 14. The enclosure 30 includes a first portion, or base plate 32 to which the housing 28 of the transformer assembly 14 is mounted. Although not shown in FIG. 1, the housing 28 can be attached to the base plate 32 with screws, other fasteners, or by any method effective to bring the transformer assembly 14 into thermal contact with the base plate 32. Although a housing, such as the housing 28, may generally surround a core and windings of a transformer, such a housing may also be in the form of strap clamps or other attachment features effective to attach the core and windings to another structure, such as the base plate 32.

As described above, the transformer assembly 14 is in "thermal contact" with the base plate 32. As used herein, the term thermal contact implies a direct or indirect physical contact between the structures, and in particular that there is either direct contact between the two structures, or there is indirect contact with another solid structure or structures disposed therebetween. For example, the core 16 is in thermal contact with the housing 28 by virtue of the thermally conductive potting material 29 being disposed between the core 16 and the housing 28. In addition, as shown in FIG. 1, a lower portion of the housing 28 is in direct contact with the base plate 32, and therefore provides thermal contact between the transformer assembly 14 and the base plate 32. To enhance heat dissipation from the transformer assembly 14 to the base plate 32, an electrical device, such as the battery charger 12, may use a coolant liquid flowing through channels (not shown) in the base plate 32.

The enclosure 30 also includes a second portion or cover, which in the embodiment shown in FIG. 1, includes a top portion 34 and side portions 36, 38. In some embodiments of a transformer-utilizing device, the side portions 36, 38 may be considered a part of the device housing, while the top portion 34 is by itself referred to as "the cover". As shown in FIG. 1, the top portion 34 includes an extension 40 extending inwardly therefrom. The extension 40 may be integrally formed with the top portion 34—i.e., the top portion 34 and the extension 40 may be made from a single piece of material. Alternatively, the extension 40 may be attached to the top portion 34 so the two structures 34, 40 are in thermal contact with each other. As explained in more detail below, this will allow heat from an upper portion of the transformer assembly 14 to dissipate through the extension 40, and ultimately through the top portion 34 of the enclosure 30.

In order to effectively dissipate heat from an upper portion of the transformer assembly 14, and in particular, from the upper portion 24 of the core 16, the extension 40 is placed in thermal contact with the housing 28. To facilitate heat transfer, the extension 40 may be manufactured to maximize contact area between it and the housing 28. It will also be made from a material having good thermal conductivity, and its surface may be manufactured to be particularly smooth and coplanar with the top of the housing 28 to further facilitate good heat transfer.

Disposed between the housing 28 and the extension 40 is a sheet of thermally conductive material 42. Although in some embodiments an extension from an enclosure, such as the extension 40, may be configured to directly contact the housing 28, having a thermally conductive material, such as the material 42, disposed between the extension 40 and a housing 28 makes the manufacturing and assembly process easier. If the extension 40 was configured to directly contact the housing 28, it could require extremely tight tolerances in manufacturing and assembly.

To reduce or eliminate potential tolerance stack-up problems, a thermally conductive material, such as the material 42 may be chosen to be made from a generally compliant solid that can fill a gap between the extension 40 and the housing 28 when the battery charger 12 is assembled. Specifically, when the transformer assembly 14 is attached to the base plate 32, and first and second portions of the enclosure 30 are connected to each other—i.e., the side portions 36, 38 are attached to the base plate 32 and the top portion 34 is attached to the side portions 36, 38—the material 42 will contact the extension 40 and the housing 28, thereby bringing the two structures into thermal contact with each other. This configuration is particularly beneficial, since the base plate 32 is disposed on an opposite side of the transformer assembly 14 from the extension 40. This helps to solve the aforementioned problem of uneven cooling between the lower and upper portions 22, 24 of the core 16.

The formation of a thermal gradient between different portions of a core—e.g., lower and upper portions 22, 24 of the core 16—can be reduced by using metal clips (described above) instead of an adhesive to hold the portions together; however, where packaging or other design considerations lead to using an adhesive material, such as the adhesive 26, the thermal gradient between the core portions may be unacceptably large. Even if metal clips are used, there still may not be enough heat dissipation from the warmer portion of the core to the cooler portion to avoid a large thermal gradient. Thus, in the embodiment shown in FIG. 1, each portion of the core 16 has its own heat sink—i.e., heat from the lower portion 22 of the core 16 will transfer substantially to the base plate 32, while heat from the upper portion 24 of the core 16 will transfer substantially to the extension 40, thereby reducing the thermal gradient between the two portions. The base plate 32 may dissipate heat through cooling channels as mentioned above, and if the top portion 34 is connected to the base plate 32 in a thermally efficient manner, for example, through the side portions 36, 38, the base plate 32 may also act to dissipate heat from the top portion 34. In addition to, or alternatively, the top portion 34 may dissipate heat through convection into the ambient air.

FIG. 2 shows a transformer arrangement 10' in accordance with another embodiment of the present invention. As shown in FIG. 2, the prime symbol (') is used on certain reference numerals to indicate features corresponding to similar features shown in FIG. 1. In the embodiment shown in FIG. 2, the extension 40' includes two portions 44, 46. As in the case of the extension 40 shown in FIG. 1, the extension 40' may be integrally formed with a top portion 34' of the enclosure 30', or it may be separately attached. In addition, the two portions 44, 46 may be formed of a single piece, or they may be separate pieces joined together.

The housing 28' of the transformer assembly 14' includes an opening 48 in a top portion, just above the upper portion 24' of the core 16'. The lower portion 46 of the extension 40' is configured to be disposed through the opening 48 so that it comes into thermal contact with the upper portion 24' of the core 16' without the housing 28' being disposed therebetween. In other embodiments, an extension or portion thereof can be configured to contact the windings of a transformer assembly, rather than the core. The upper portion 44 of the extension 40' is in thermal contact with the housing 28', similar to the configuration shown in FIG. 1.

A thermally conductive material 50, which may or may not be the same material as the material 42, 42', is disposed between the lower portion 46 of the extension 40' and the upper portion 24' of the core 16'. A material, such as the material 50, can also be disposed between a transformer core and transformer housing, such as the upper portion 24 of the core 16 and the housing 28 shown in FIG. 1. In addition to facilitating thermal conduction, a material, such as the material 50, may act as a dielectric to electrically isolate a transformer core from its housing. As shown in FIG. 2, a portion of the thermally conductive material 50 is also disposed between the upper portion 24' of the core 16' and the housing 28'. This may be in addition to, or it may replace, the potting material 29' that would otherwise be disposed around a top surface of the upper portion 24' of the core 16'.

The opening 50 may be configured so as to maximize the area of contact between the lower portion 46 of the extension 40' and the upper portion 24' of the core 16', it being understood that manufacturing and assembly considerations may limit the size or shape of the opening 50 and the lower portion 46 of the extension 40'. The surface area of the lower portion 46 that comes into thermal contact with the upper portion 24' of the core 16' may be determined, for example, based on the cooling needs of the upper portion 24' and the structural requirements of the transformer assembly 14'. As noted above, embodiments of the invention may be particularly beneficial for electromagnetic devices having ferrite cores, which have a low tensile strength; however, for devices having metal cores with higher tensile strength, embodiments of the invention can also be beneficial by dissipating the heat from the windings, which can be significant.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A electromagnetic device arrangement, comprising:

an electromagnetic device including a core, a plurality of windings, and a housing disposed around at least a portion of the core and windings and defining a space therebetween; and an enclosure at least partially enclosing the electromagnetic device, a first portion of the enclosure having the electromagnetic device mounted thereto such that heat is transferred from the electromagnetic device to the first portion of the enclosure, a second portion of the enclosure having an extension extending therefrom such that the extension is placed in thermal contact with the electromagnetic device such that heat is transferred from the electromagnetic device to the extension.

2. The electromagnetic device arrangement of claim 1, wherein the first portion of the enclosure is a base and the second portion of the enclosure is a cover connected to the base to form the enclosure.

3. The electromagnetic device arrangement of claim 2, wherein the extension is placed in thermal contact with the electromagnetic device on a side of the electromagnetic device opposite the base.

4. The electromagnetic device arrangement of claim 1, wherein the extension is placed in thermal contact with the electromagnetic device such that the extension is in thermal contact with the housing.

5. The electromagnetic device arrangement of claim 1, wherein the housing includes an opening therein, and the extension is configured to be disposed through the opening such that at least a portion of the extension is in thermal contact with the core without the housing being disposed therebetween.

6. The electromagnetic device arrangement of claim 1, wherein the extension is placed in thermal contact with the electromagnetic device such that a portion of the extension is in thermal contact with the housing and another portion of the extension is in thermal contact with the core without the housing being disposed therebetween.

7. The electromagnetic device arrangement of claim 1, further comprising a thermally conductive material disposed between the extension and the electromagnetic device.

8. The electromagnetic device arrangement of claim 1, wherein the core includes first and second portions connected to each other with an adhesive material, the electromagnetic device being disposed relative to the enclosure such that heat from the first portion of the core transfers substantially to the first portion of the enclosure, and heat from the second portion of the core transfers substantially to the extension.

9. An electrical device, comprising:

an electromagnetic device including a plurality of windings, a split core bonded together with an adhesive material, and a housing disposed at least partially around the windings and the core and defining a space therebetween;

a base plate having the electromagnetic device mounted thereto and in thermal contact therewith, such that heat from a first portion of the core transfers substantially to the base plate; and a cover attachable to the base plate to form an enclosure at least partially enclosing the electromagnetic device, the cover including an extension extending therefrom and in thermal contact with the electromagnetic device when the cover is attached to the base plate, the thermal contact between the extension and the electromagnetic device being such that heat from a second portion of the core transfers substantially to the extension.

10. The electrical device of claim 9, wherein the extension is placed in thermal contact with the electromagnetic device such that heat transferred from the second portion of the core to the extension inhibits a thermal gradient between the first and second portions of the core.

11. The electrical device of claim 9, wherein the extension is placed in thermal contact with the electromagnetic device such that the extension is in thermal contact with at least one of the housing and the core without the housing being disposed therebetween.

12. The electrical device of claim 9, further comprising a thermally conductive material disposed between the extension and the electromagnetic device.

13. An electromagnetic device arrangement, comprising:

an enclosure including a first portion and a second portion; and an electromagnetic device including a core, a plurality of windings, and a housing disposed around at least a portion of the core and windings and defining a space therebetween, the electromagnetic device being mounted to and in thermal contact with the first portion of the enclosure, the second portion of the enclosure being configured to thermally contact the electromagnetic device when the first and second portions of the enclosure are attached to each other.

14. The electromagnetic device arrangement of claim 13, wherein the second portion of the enclosure includes an extension projecting therefrom such that the extension thermally contacts the electromagnetic device when the first and second portions of the enclosure are attached to each other.

15. The electromagnetic device arrangement of claim 14, wherein the extension is placed in thermal contact with the electromagnetic device such that a portion of the extension is in thermal contact with the housing and another portion of the extension is in thermal contact with the core without the housing being disposed therebetween.

16. The electromagnetic device arrangement of claim 14, further comprising a thermally conductive material disposed between the extension and the electromagnetic device.

17. The electromagnetic device arrangement of claim 14, wherein the first portion of the enclosure includes a base and the second portion of the enclosure includes a cover connected to the base to form the enclosure.

18. The electromagnetic device arrangement of claim 17, wherein the extension is placed in thermal contact with the electromagnetic device on a side of the electromagnetic device opposite the base.

19. The electromagnetic device arrangement of claim 17, wherein the core includes first and second portions connected to each other with an adhesive material, the electromagnetic device being disposed relative to the enclosure such that heat from the first portion of the core transfers substantially to the base, and heat from the second portion of the core transfers substantially to the extension.

20. The electromagnetic device arrangement of claim 13, further comprising a thermally conductive material disposed between the second portion of the enclosure and the electromagnetic device.

* * * * *